US007348737B2

(12) United States Patent
Fujii et al.

(10) Patent No.: US 7,348,737 B2
(45) Date of Patent: Mar. 25, 2008

(54) LIGHTING CIRCUIT FOR HIGH-PRESSURE DISCHARGE LAMP

(75) Inventors: Toshitaka Fujii, Himeji (JP); Atsuji Nakagawa, Himeji (JP)

(73) Assignee: Phoenix Electric Co., Ltd., Himeji-Shi (JP)

( * ) Notice: Subject to any disclaimer, the term of this patent is extended or adjusted under 35 U.S.C. 154(b) by 107 days.

(21) Appl. No.: 11/457,837

(22) Filed: Jul. 17, 2006

(65) Prior Publication Data

US 2007/0024204 A1 Feb. 1, 2007

(30) Foreign Application Priority Data

Aug. 1, 2005 (JP) ..... 2005-223168
Jun. 19, 2006 (JP) ..... 2006-168727

(51) Int. Cl.
*G05F 1/00* (2006.01)

(52) U.S. Cl. ..... 315/307; 315/291; 315/247; 315/209 R; 315/289; 315/DIG. 5; 315/DIG. 7; 353/85

(58) Field of Classification Search ..... 315/209 R, 315/291, 219, 247, 224, 289, 290, 307, 360, 315/362, DIG. 5, DIG. 7; 353/49, 85; 363/34, 363/37, 41, 74
See application file for complete search history.

(56) References Cited

U.S. PATENT DOCUMENTS 5,982,645 A * 11/1999 Levran et al. ..... 363/37
6,781,328 B2 * 8/2004 Horiuchi et al. ..... 315/291
6,867,556 B2 * 3/2005 Arimoto et al. ..... 315/291
7,012,374 B2 * 3/2006 Kurimoto et al. ..... 313/637
2006/0170379 A1 * 8/2006 Uchida ..... 315/312

FOREIGN PATENT DOCUMENTS

JP H08-47261 9/1974
JP 8330081 12/1996
JP 2001-0348731 A 5/2003
JP 2002-229070 A 9/2005

* cited by examiner

*Primary Examiner*—Haissa Philogene
(74) *Attorney, Agent, or Firm*—Lucas & Mercanti, LLP

(57) ABSTRACT

To provide a lighting circuit of a projector that can be driven by both the commercial alternating-current power supply and a battery and is convenient for portable use. A lighting circuit for a high-pressure discharge lamp 14 includes: a DC/DC converter 1 that boosts a direct-current voltage and outputs the boosted direct-current voltage; an AC/DC converter 10 that rectifies an alternating-current voltage to output a direct-current voltage; an input switch circuit 2 and a power switch circuit 3 that switch between the DC/DC converter 1 and the AC/DC converter 10; a ballast circuit 11 that stabilizes the lighting of the high-pressure discharge lamp 14; a power control section 12 that controls the power supply from the ballast circuit 11 to the high-pressure discharge lamp 14; a lighting initiation circuit 13 that starts lighting of the high-pressure discharge lamp 14; and the high-pressure discharge lamp 14, and the power switch circuit 3 performs power switching in such a manner that a relatively low power is supplied to the high-pressure discharge lamp 14 when a direct-current power supply is connected only to the DC/DC converter, and a relatively high power is supplied to the high-pressure discharge lamp 14 when the commercial alternating-current power supply is connected to the AC/DC converter 10.

2 Claims, 3 Drawing Sheets

LIGHTING CIRCUIT FOR HIGH-PRESSURE DISCHARGE LAMP

BACKGROUND OF THE INVENTION

1. Field of the Invention

The present invention relates to a portable battery-driven projector (projection imaging equipment). In particular, it relates to a lighting circuit for a high-pressure discharge lamp used as a light source.

2. Description of the Related Art

A direct-current high-pressure discharge lamp (high-pressure mercury vapor lamp) used as a light source of a projector generally has a high rated power (120 W or more, for example) and is considered difficult to drive by a battery. Thus, many projectors are connected to the commercial alternating-current power supply (AC 100 V, for example) and convert the alternating-current power to the direct-current power by an AC/DC converter for lighting.

FIG. 3 is a block diagram showing a conventional lighting circuit for a high-pressure discharge lamp. As shown in this drawing, the lighting circuit comprises an AC/DC converter 50, a ballast circuit 51, a power control section 52, alighting initiation circuit 53, and a high-pressure discharge lamp 54. Light emitted by the high-pressure discharge lamp 54 generates an image through an optical engine 55, and the image is projected onto a screen S.

Because the sealing technique for the high-pressure discharge lamp has been improved in recent years, higher mercury vapor pressure can be achieved during stable lighting. Thus, the light emission efficiency has been improved. Consequently, high-pressure discharge lamps having a rated power of 100 W or lower have been developed. However, the rated power of 100 W is still considered too high to use a battery to drive the lamp.

In the Documents of the related art 1, 2 and 4 described below, battery-driven projectors are disclosed, and in the Document of the related art 3, a discharge lighting device for a battery-driven liquid crystal backlight is disclosed. According to the techniques proposed in these documents, all the electric power excluding the part for the light source is supplied from the personal computer to reduce power consumption, or the brightness of the light source is decreased in response to the decrease of the remaining battery power.

[Document 1]: Japanese Patent Laid-Open No. 2004-69997

[Document 2]: Japanese Patent Laid-Open No. 2003-149733

[Document 3]: Japanese Patent Laid-Open No. 8-330081

[Document 4]: Japanese Patent Laid-Open No. 8-47261

SUMMARY OF THE INVENTION

To light a high-pressure discharge lamp (high-pressure mercury vapor lamp) used as a light source of a projector, a direct-current voltage of 1 kV or higher is required to arise dielectric breakdown. To maintain a glow discharge and to arise a transition from the glow discharge to an arc discharge, a direct-current voltage of 200 to 300 V is required. Thus, in order to use a battery to drive the high-pressure discharge lamp, a DC/DC converter or the like has to be used to achieve the required voltage. However, as the output power of the DC/DC converter increases, the circuit size thereof also increases, and the battery becomes larger and heavier, so that the projector becomes less suitable for portable use.

The rated power of the high-pressure discharge lamp is determined based on the optimal values of the current and voltage input thereto. If a power equal to or lower than the rated power is input, problems may cause that the discharge cannot be maintained and that a flicker occurs, depending on the condition. Thus, when a power equal to or lower than the rated power is input, an optimal power has to be input by taking into consideration the characteristics of the high-pressure discharge lamp.

In view of the above problems in the related art, it is an object of the present invention to provide a lighting circuit for a projector that can be driven by both the commercial alternating-current power supply and a battery and is convenient for portable use.

In accordance with a fist aspect of the present invention, a lighting circuit for a high-pressure discharge lamp is a circuit for lighting a high-pressure discharge lamp 14 used as a light source of a projector, comprising: a DC/DC converter 1 that boosts a direct-current voltage and outputs the boosted direct-current voltage; an AC/DC converter 10 that rectifies an alternating-current voltage to output a direct-current voltage; an input switch circuit 2 and a power switch circuit 3 that switch between the DC/DC converter 1 and the AC/DC converter 10; a ballast circuit 11 that stabilizes the lighting of the high-pressure discharge lamp 14; a power control section 12 that controls the power supply from the ballast circuit 11 to the high-pressure discharge lamp 14; a lighting initiation circuit 13 that starts lighting of the high-pressure discharge lamp 14; and the high-pressure discharge lamp 14, in which the power switch circuit 3 performs power switching in such a manner that a first power is supplied to the high-pressure discharge lamp 14 when a direct-current power supply is connected only to the DC/DC converter 1, and a second power higher than the first power is supplied to the high-pressure discharge lamp 14 when an alternating-current power supply is connected to the AC/DC converter 10.

Normally, in order to prevent a flicker or other effects, a rated power is supplied to the high-pressure discharge lamp 14. However, one of the characteristics of the present invention is that the high-pressure discharge lamp 14 is driven by a power equal to or lower than the rated power during battery driving.

In this case, the high-pressure discharge lamp 14 used preferably has a rated power of 100 W or lower, preferably on the order of 60 W to 80 W. When the high-pressure discharge lamp 14 is driven by a direct-current power supply (an external battery, an AC adapter or the like), at least 40 to 60% of the rated power, preferably about 50% of the rated power is supplied (first power). This is because at least 40% or higher of the rated power of the high-pressure discharge lamp 14 has to be supplied in order to stably maintain the discharge while preventing from flickering. When the commercial alternating-current power supply (AC 100 V or AC 200 V, for example) can be used, about 100% of the rated power (second power) is supplied. The input switch circuit 2 and the power switch circuit 3 perform switching between these "power supply" states.

In accordance with a second aspect of the present invention, a lighting circuit for a high-pressure discharge lamp is a circuit for lighting a high-pressure discharge lamp 20 used as a light source of a projector, comprising: the high-pressure discharge lamp 20; a lighting initiation circuit 38 that starts lighting of the high-pressure discharge lamp 20; a ballast circuit 34 that stabilizes the lighting of the high-pressure discharge lamp 20; a power control section 36 that controls the power supply from the ballast circuit 34 to the high-pressure discharge lamp 20; a power switch circuit 32 that controls the operation of the power control section 36; a DC/DC converter 30 that boosts a direct-current voltage and outputs the boosted direct-current voltage to the ballast circuit 34; an input switch circuit 28 that supplies a direct-current voltage to the DC/DC converter 30; a driver circuit 22 that outputs a direct-current voltage which is input to the driver circuit 22 to the power switch circuit 32 and the input switch circuit 28; a battery 26 that supplies a direct-current voltage to the input switch circuit 28; and a charger circuit 24 that supplies a direct-current voltage which is input to the driver circuit 22 to the battery 26, in which the power switch circuit 32 performs power switching in such a manner that a first power is supplied from the battery 26 to the high-pressure discharge lamp 20 when a direct-current voltage is not output from the driver circuit 22, and a second power higher than the first power is supplied to the high-pressure discharge lamp 20 when a direct-current voltage is output from the driver circuit 22.

The lighting circuit for the high-pressure discharge lamp 20 according to the present invention has the battery 26, and the external direct-current voltage input to the lighting circuit is not only input to the driver circuit 22 and then supplied to the high-pressure discharge lamp 20 but also supplied to the charger circuit 24. Therefore, the battery 26 is charged by the charger circuit 24. On the other hand, when there is no external direct-current voltage input, the charged battery 26 supplies a direct-current voltage to the input switch circuit 28.

The present invention provides a lighting circuit for a projector that can be driven by a battery and is convenient for portable use. For example, in the case where a high-pressure discharge lamp 14 having a rated power of about 60 W is driven by a power that is 50% of the rated power, the output power is about 30 W. A brightness of about 200 Lm (Lumen) can be achieved with this level of power, and the high-pressure discharge lamp 14 can be driven by a battery for a practically sufficient length of time. For example, a battery having a capacity of 50 Wh can drive the high-pressure discharge lamp 14 including the optical engine 15 and other circuits for at least one hour or more. In addition, if the commercial alternating-current power supply can be used, 100% of the rated power may be input to achieve a brightness of about 400 Lm.

In addition, according to the second aspect of the present invention, if the battery 26 is charged before use, a lighting circuit of a projector that requires neither the commercial alternating-power supply nor any external battery and is further convenient for portable use can be provided.

DETAILED DESCRIPTION OF THE INVENTION

Figure 1:
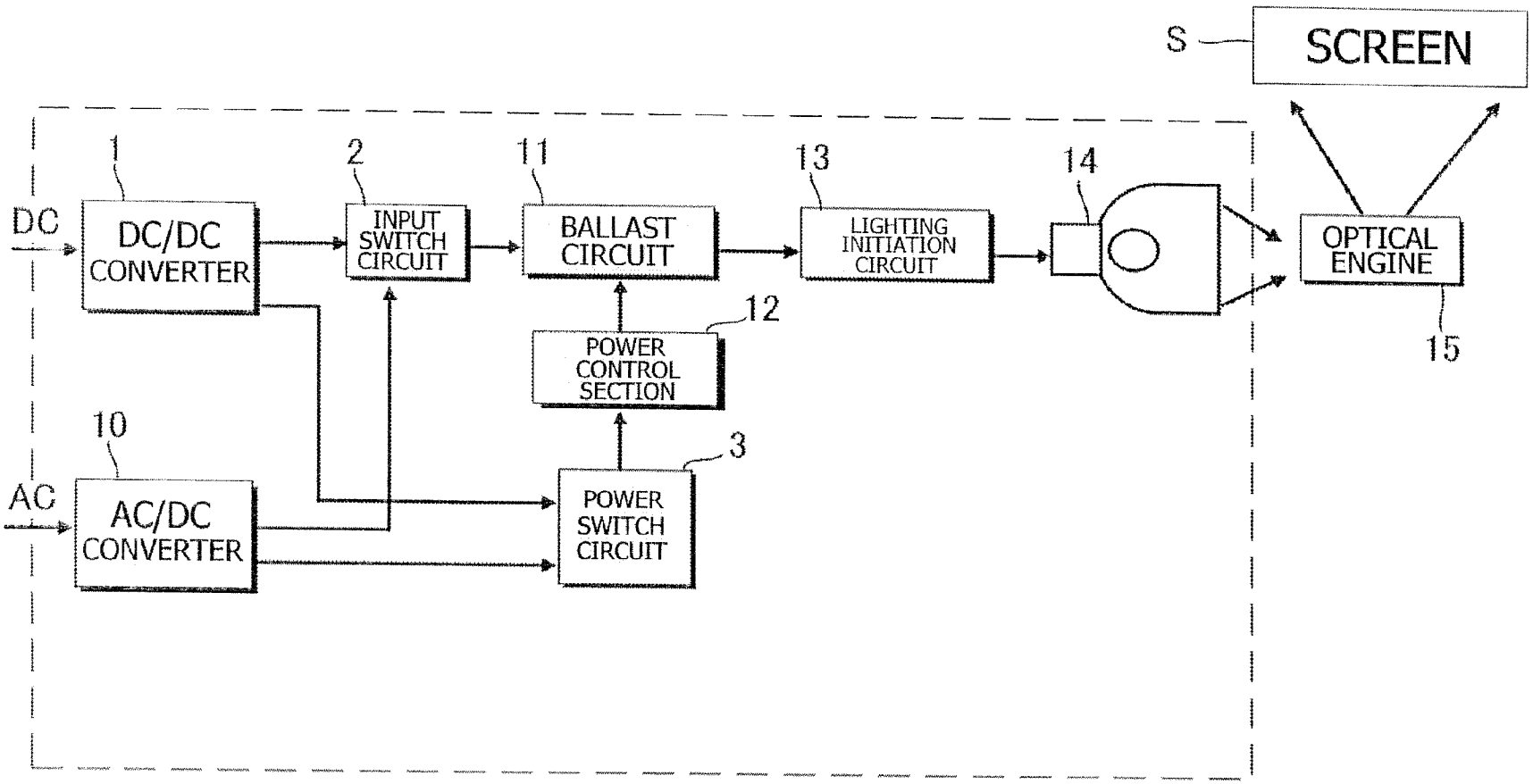
FIG. 1 is a block diagram showing a lighting circuit for a high-pressure discharge lamp according to a first embodiment of the present invention.

In the following, the present invention will be described with reference to the drawings. FIG. 1 is a block diagram showing a lighting circuit for a high-pressure discharge lamp 14 according to a first embodiment of the present invention. This circuit comprises a dual power input section designed for DC 12 V and AC 100 V (or 200 V), and the input power to a high-pressured is charge lamp 14 is switched by an input switch circuit 2 and a power switch circuit 3.

A DC/DC converter 1 generates a direct-current voltage to be supplied to a ballast circuit 11 from the voltage of DC 12 V from a battery. The output voltage required to maintain a glow discharge of the high-pressure discharge lamp 14 and arise a transition from the glow discharge to an arc discharge is 200 V or higher. In terms of size reduction of the circuit, a high-frequency push-pull inverter circuit is preferably used. And the DC/DC converter 1 boosts the input voltage of DC 12 V to a direct-current voltage of about 250 to 300 V.

The input switch circuit 2 is a circuit for switching the direct-current voltage supplied to the ballast circuit 11 and switches the power supplied to the ballast circuit 11 between the output of the DC/DC converter 1 and the output of an AC/DC converter 10 by a mechanical switch, a semiconductor switch (an OR circuit composed of a diode or the like) or the like.

The power switch circuit 3 is a logic circuit that supplies an operation switching signal that makes a power control section 12 supply a lower power to the high-pressure discharge lamp 14 when the power is input from a external battery and supply a higher power when the power is input from the commercial alternating-current power supply.

The AC/DC converter 10 rectifies the commercial alternating-current voltage to generate a direct-current voltage to be supplied to the ballast circuit 11. An output voltage of DC 200 V or higher can be generated by voltage doubling of AC 100 V or full-wave rectification of AC 200 V or using a power factor correction (PFC) circuit.

The ballast circuit 11 is connected to a lighting initiation circuit 13 and controls the power so that a rated power is supplied to the high-pressure discharge lamp 14 during stable lighting. Normally, a down converter (referred to also as chopper circuit) is used as the ballast circuit 11.

The power control section 12 is a circuit that controls the ballast circuit 11 so that a relatively low power (first power) is supplied to the high-pressure discharge lamp 14 when the power of the external battery is input. And a relatively high power (second power) is supplied to the high-pressure discharge lamp 14 when the power of the commercial alternating-current power supply is input. Normally, the output voltage and current are detected and then input to a pulse width modulation (PWM) circuit and the like after calculation.

The lighting initiation circuit 13 generates a high voltage of 1 kV or higher to arise dielectric breakdown between electrodes of the high-pressure discharge lamp 14, thereby activating the high-pressure discharge lamp 14. The high-pressure discharge lamp 14 is attached to a concave reflection mirror.

Light flux from the high-pressure discharge lamp 14 is incident on an optical engine 15, and the colored light emitted from a projection lens of the optical engine 15 is projected onto a screen S.

For use as a lighting circuit for a convenient portable projector that can be driven by an external battery, the power supplied to the high-pressure discharge lamp 14 is preferably equal to or lower than 40 W, for example, on the order of 30 W. If the power is higher than this level, the circuit size of the DC/DC converter 1 is too large, and the battery is too heavy, so that the circuit loses its portability. Even when an on-vehicle battery can be used, the adequate power is on the order of 30 W. Even with this level of power, a luminance of about 200 Lm can be achieved on the screen S. Even this level of luminance is sufficient for business use, such as presentation, and any side effects, such as a flicker, do not occur.

In the case where the circuit is used indoors for home theater or other household use, the luminance of 200 Lm is slightly insufficient. However, the commercial alternating-current power supply can be used indoors, so that the power of the high-pressure discharge lamp can be raised. In order to use the same high-pressure discharge lamp for both uses, the raised power of the high-pressure discharge lamp is preferably equal to or higher than 50 W, for example, on the order of 60 W. This level of power can achieve a screen luminance of about 400 Lm, which is sufficiently practical.

In this way, the direct-current power supply and the commercial alternating-current power supply is switchably used, and the high-pressure discharge lamp 14 is driven with a power equal to or lower than the rated power depending on the type of the input power supply.

Figure 2:
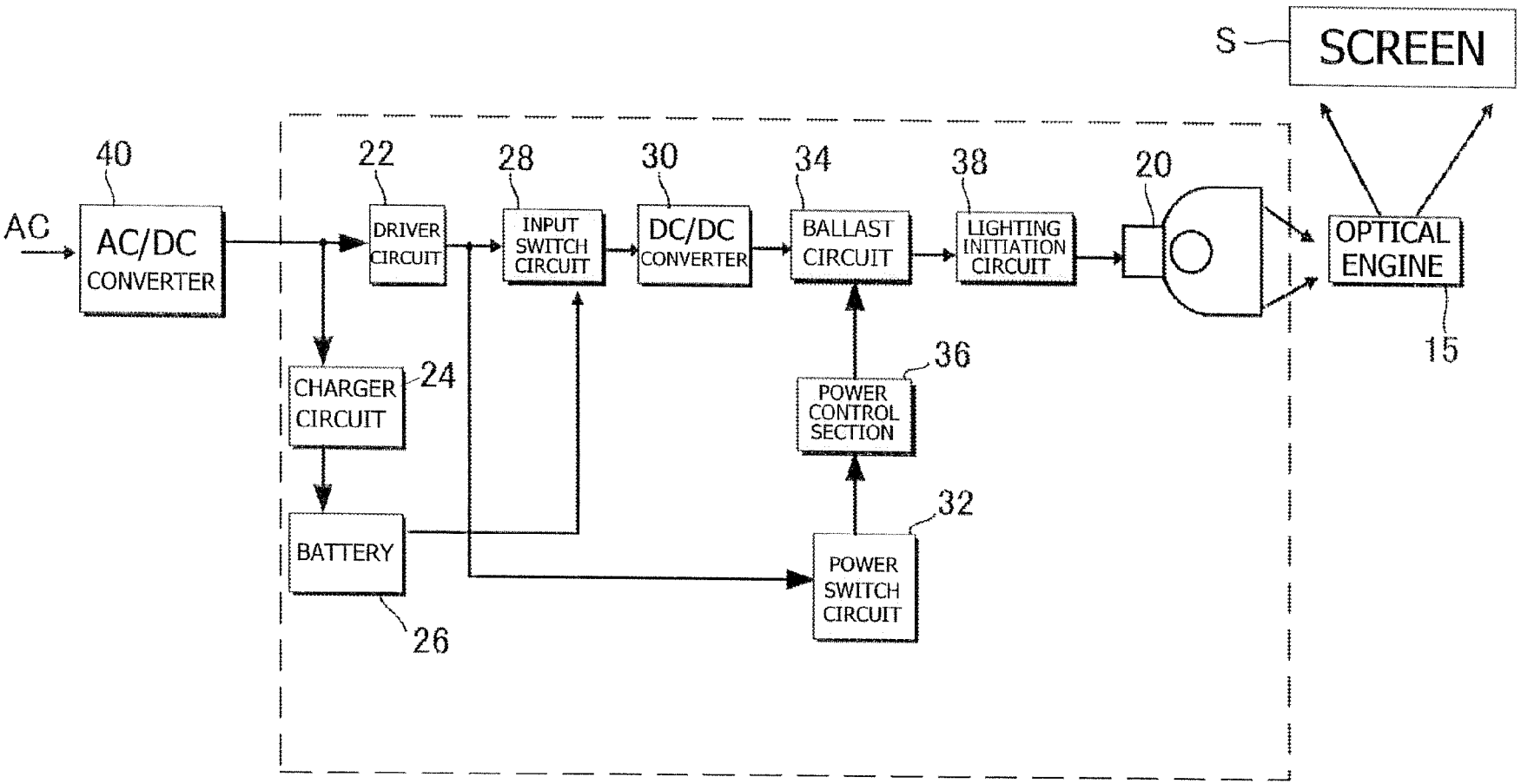
FIG. 2 is a block diagram showing a lighting circuit for a high-pressure discharge lamp according to a second embodiment of the present invention.
Figure 3:
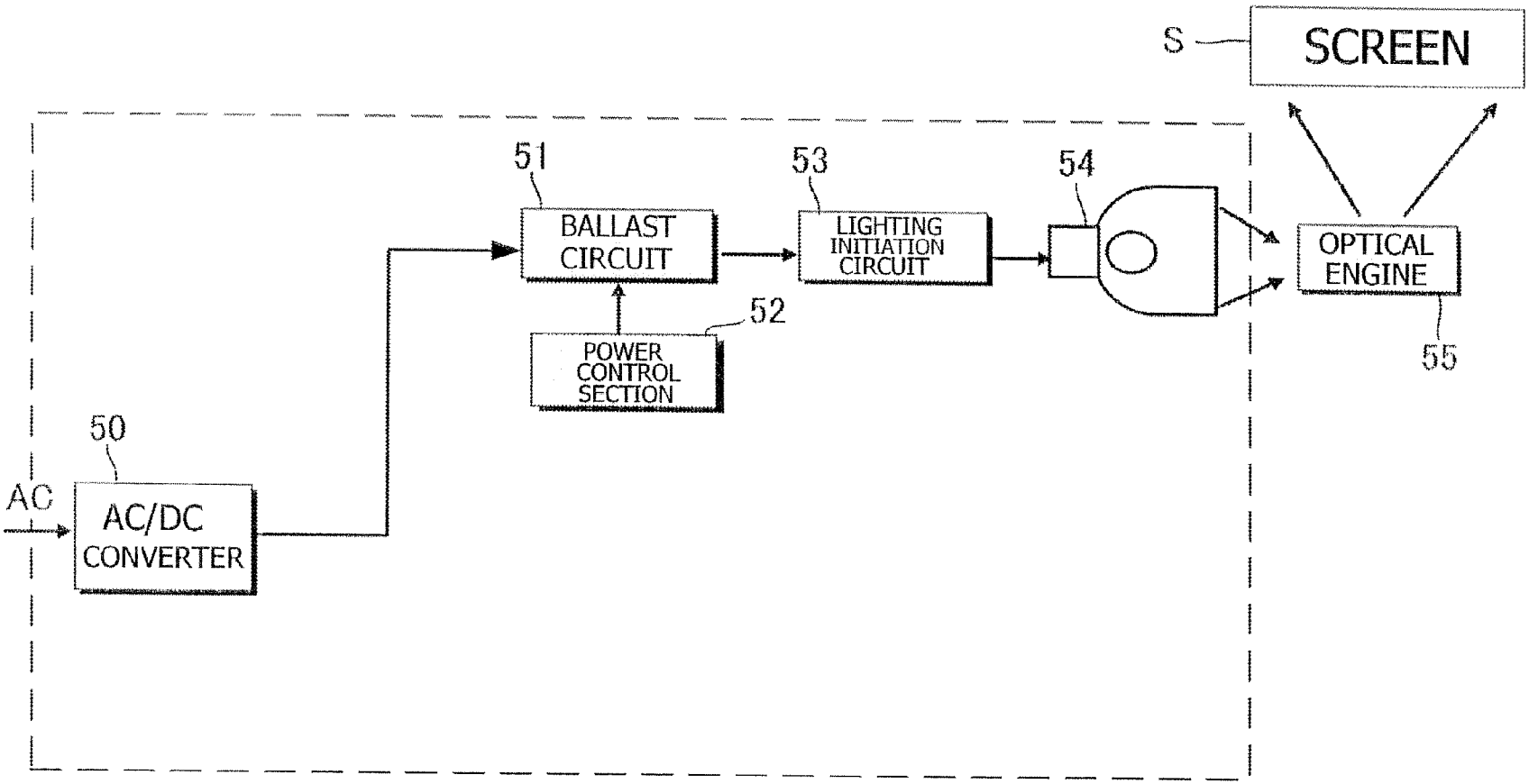
FIG. 3 is a block diagram showing a conventional lighting circuit for a high-pressure discharge lamp.

FIG. 2 is a block diagram showing a lighting circuit for a high-pressure discharge lamp 20 according to a second embodiment of the present invention. This circuit comprises a driver circuit 22 and a charger circuit 24 that receive an external input direct-current voltage, a battery 26, an input switch circuit 28, a DC/DC converter 30, a power switch circuit 32, a ballast circuit 34, a power control section 36 and a lighting initiation circuit 38.

The input switch circuit 28 is a circuit for switching the direct-current voltage to be supplied to the DC/DC converter 30 between the output of the driver circuit 22 and the output of the battery 26 by a mechanical switch, a semiconductor switch (an OR circuit composed of a diode or the like) or the like.

The DC/DC converter 30 is a device that boosts the direct-current voltage from the input switch circuit 28 to a direct-current voltage to be supplied to the ballast circuit 34. The output voltage required to maintain a glow discharge of the high-pressure discharge lamp 20 and cause a transition from the glow discharge to an arc discharge is 200 V or higher. To reduce the size of the circuit, a high-frequency push-pull inverter circuit or a chopper up-converter circuit can be used.

The power switch circuit 32 is a logic circuit that supplies, to the power control section 36, an operation switching signal that instructs the power control section 36 to supply a lower power to the high-pressure discharge lamp 20 when the power of the battery 26 is used and to supply a higher power when an external direct-current voltage is supplied. In addition, according to this embodiment, the direct-current voltage supplied from the driver circuit 22 to the input switch circuit 28 is branched to the power switch circuit 32. When the direct-current voltage is supplied to the power switch circuit 32, the power switch circuit 32 determines that an external direct-current voltage is supplied to the lighting circuit according to the present invention.

The ballast circuit 34 is connected to the lighting initiation circuit 38 and controls the power so that a rated power is supplied to the high-pressure discharge lamp 20 during stable lighting. Normally, a down converter (referred to also as chopper circuit) is used as the ballast circuit 34.

The power control section 36 is a circuit that controls the ballast circuit 34 so that a relatively low power (first power) is supplied to the high-pressure discharge lamp 20 when a direct-current voltage is applied to the input switch circuit 28 from the battery 26 and a relatively high power (second power) is supplied to the high-pressure discharge lamp 20 when an external direct-current voltage is applied to the input switch circuit 28. Normally, the output voltage and current are detected and then input to a pulse width modulation (PWM) circuit and the like after calculation.

The lighting initiation circuit 38 generates a high voltage of 1 kV or higher to arise dielectric breakdown between electrodes of the high-pressure discharge lamp 20, thereby activating the high-pressure discharge lamp 20.

The high-pressure discharge lamp 20 is attached to a concave reflection mirror.

Light flux from the high-pressure discharge lamp 20 is incident on an optical engine 15, and the colored light emitted from a projection lens of the optical engine 15 is projected onto a screen S.

In addition, the lighting circuit according to this embodiment is configured so that the voltage applied to the high-pressure discharge lamp 20 can be switched by the input switch circuit 28 and the power switch circuit 32 in such a manner that, when an external direct-current voltage is applied, the direct-current voltage is applied to the high-pressure discharge lamp 20 via the driver circuit 22, and when the direct-current voltage applied externally is interrupted, the direct-current voltage from the battery 26 is applied to the high-pressure discharge lamp 20.

To the lighting circuit according to this embodiment, an external direct-current voltage is supplied from an AC/DC converter 40 (referred to as AC adapter) that rectifies the alternating-current voltage from the commercial alternating-current power supply to generate a direct-current voltage.

In addition, the means of supplying a direct-current voltage is not limited thereto, and a direct-current voltage may be supplied to the lighting circuit according to this embodiment from external battery (not shown), which is not a component of the lighting circuit.

In addition, while the battery 26 for the lighting circuit used in this embodiment is a shielded battery that generates a voltage of 12 V, any other batteries that generate a direct-current voltage can be used.

In addition, details about the power supplied to the high-pressure discharge lamp 20 are the same as described above with regard to the first embodiment.

What is claimed is:

1. A lighting circuit for a high-pressure discharge lamp used as a light source of a projector, comprising:

a DC/DC converter that boosts a direct-current voltage and outputs the boosted direct-current voltage;

an AC/DC converter that rectifies an alternating-current voltage to output a direct-current voltage;

an input switch circuit and a power switch circuit that switch between the DC/DC converter and the AC/DC converter;

a ballast circuit that stabilizes the lighting of said high-pressure discharge lamp;

a power control section that controls the power supply from said ballast circuit to said high-pressure discharge lamp;

a lighting initiation circuit that starts lighting of said high-pressure discharge lamp; and the high-pressure discharge lamp, wherein said power switch circuit performs power switching in such a manner that a first power is supplied to said high-pressure discharge lamp when a direct-current power supply is connected only to said DC/DC converter, and a second power higher than said first power is supplied to said high-pressure discharge lamp when an alternating-current power supply is connected to said AC/DC converter.

2. A lighting circuit for a high-pressure discharge lamp used as a light source of a projector, comprising:

the high-pressure discharge lamp;

a lighting initiation circuit that starts lighting of said high-pressure discharge lamp;

a ballast circuit that stabilizes the lighting of said high-pressure discharge lamp;

a power control section that controls the power supply from said ballast circuit to said high-pressure discharge lamp;

a power switch circuit that controls the operation of said power control section;

a DC/DC converter that boosts a direct-current voltage and outputs the boosted direct-current voltage to said ballast circuit;

an input switch circuit that supplies a direct-current voltage to said DC/DC converter;

a driver circuit that outputs an input direct-current voltage to said power switch circuit and said input switch circuit;

a battery that supplies a direct-current voltage to said input switch circuit; and a charger circuit that supplies an input direct-current voltage to said battery, wherein said power switch circuit performs power switching in such a manner that a first power is supplied from said battery to said high-pressure discharge lamp when a direct-current voltage is not output from said driver circuit, and a second power higher than said first power is supplied to said high-pressure discharge lamp when a direct-current voltage is output from said driver circuit.

* * * * *